United States Patent [19]

Weeks

[11] Patent Number: 4,993,753

[45] Date of Patent: Feb. 19, 1991

[54] SELF-ASSEMBLED PERSONALIZED HIDDEN MESSAGE DEVICE

[76] Inventor: Bruce W. Weeks, 27 Twombley Ave., North Billerica, Mass. 01862

[21] Appl. No.: 387,061

[22] Filed: Jul. 28, 1989

[51] Int. Cl.[5] ..... B42D 15/00

[52] U.S. Cl. ..... 283/102; 283/108; 283/109; 283/110; 283/111; 283/901; 283/903

[58] Field of Search ..... 283/903, 102, 110, 111, 283/108, 109, 901

[56] References Cited

U.S. PATENT DOCUMENTS

| | | | |
|---|---|---|---|
| 3,950,013 | 4/1976 | Tagliaferri | 283/111 |
| 4,273,362 | 6/1981 | Carrier et al. | 283/903 |
| 4,693,496 | 9/1987 | Leonetti et al. | 283/903 |
| 4,708,369 | 11/1987 | Greig | 283/903 |
| 4,778,153 | 10/1988 | Bachman | 283/903 |
| 4,850,618 | 7/1989 | Halladay | 283/903 |

*Primary Examiner*—Paul A. Bell

*Attorney, Agent, or Firm*—Joseph S. Iandiorio; Brian M. Dingman

[57] ABSTRACT

A self-assembled personalized message device including a base substrate with one or more blank areas on which messages can be written; a transparent cover sheet for covering the message areas, a material for adhering the cover sheet to the substrate, and a removable, opaque coating on the cover sheet for obscuring the message area when the cover sheet is adhered to the substrate in which the opaque material is capable of being rubbed off the cover sheet to selectively reveal the message written in the message areas.

9 Claims, 3 Drawing Sheets

SELF-ASSEMBLED PERSONALIZED HIDDEN MESSAGE DEVICE

FIELD OF INVENTION

This invention relates to a self-assembled personalized hidden message device which can take the form of an imitation lottery ticket, a greeting card or a book, for example.

BACKGROUND OF INVENTION

Currently, most printed materials, for example, books, greeting cards, and lottery tickets, are fully printed before their purchase. With devices such as greeting cards which are meant to convey a message, one must choose from a limited number of messages available; the correct or desired message is not always available for purchase. In addition, the message conveyed is not one chosen or composed by the sender.

Children's books are used as tools for teaching reading and writing. These books typically have simple sentences with illustrations to convey the meaning of the text. In books which are meant to teach both reading and writing, it is known to leave blanks in the text which the child can fill in. The blank areas are typically filled in in such a way that the word written thereon may be erased to allow the books to be reused. The parent or teacher may then instruct the child by reviewing the text after the child has filled in the blanks. In this way, the child is taught to comprehend the text at the same time she or he is taught to read and write. However, in this learning process it is necessary to have an adult review the material to correct any mistakes. As a result, the child cannot learn without adult supervision.

SUMMARY OF INVENTION

It is therefore an object of this invention to provide a message device in which the message is personalized.

It is a further object of this invention to provide a self-assembled personalized hidden message device.

It is a further object of this invention to provide such a device in the form of a greeting card.

It is a further object of this invention to provide such a device in the form of a book for self-teaching by the pupil.

It is a further object of this invention to provide a partially preprinted instructional guide in which an instructor may tailor the text as desired.

It is a further object of this invention to provide a personalized novelty imitation lottery ticket.

This invention features a self-assembled personalized hidden message device including a base substrate with a surface including one or more blank areas in which messages can be written, a transparent cover sheet for covering said message area, and means for adhering the cover sheet to the base substrate. Further included is a removable opaque coating on the cover sheet for obscuring the message area, in which the opaque material is capable of being rubbed off of the cover sheet to selectively reveal the message in the message area. Preferably, the adhesive is on the cover sheet. A backing sheet removably adhered to the adhesive material or other means for provisionally protecting the adhesive material before assembly may be included. The cover sheet is then preferably capable of being peeled away from the backing sheet to allow the opaque adherent areas to be stuck on the blank areas to temporarily hide the message written thereon.

In a preferred embodiment, the cover sheet is the same size as the base substrate for entirely covering the substrate. In that case, the opaque areas are preferably arranged on the cover sheet to be aligned with the message areas when the cover sheet is stuck to the base substrate so that the entire cover sheet may be placed on the base without having to align the individual opaque areas with the individual message areas. Alternatively, the opaque adherent areas may be individually removable from the cover sheet to allow selective covering of the message areas. In any case, the opaque coating is preferably approximately the same size as the message areas for substantially covering them.

The base substrate may be a paper card. The surface of the base substrate surrounding the message areas may include the adhesive material. Preferably, the base substrate is preprinted outside of the blank message areas to provide a device which has a preestablished form. For example, the printed substrate may be a greeting card or an imitation lottery ticket. In another embodiment, the device is a book. In that case, the book is preferably partially preprinted with the blank areas being placed as missing words in sentences in the book to act as an instructional guide.

In another preferred embodiment, the self-assembled personalized message device comprises an imitation lottery ticket and includes a paper substrate including printed areas and a number of blank areas on which messages can be written to imitate a lottery ticket, and a transparent cover sheet approximately the same size as the substrate and including a plurality of cover areas on one face corresponding to the blank areas on the substrate and an adhesive material at least partly covering the other face. Further included is a backing sheet removably adhered to the adhesive material to protect it before assembly; the backing sheet is capable of being peeled off of the cover sheet to allow the cover sheet to be stuck on the printed surface. A removable opaque coating is included on the cover areas for obscuring the message areas, the coating capable of being rubbed off of the cover sheet to selectively reveal the message written in the message areas.

In yet another embodiment, the device may be a sticker, and include an adhesive-backed paper sticker, the adhesive removably covered with a material for protecting the adhesive before use. The face of the sticker includes a blank area for containing a message. Further included is an opaque sticker with an adhesive-backed transparent substrate covered on the front with a removable opaque coating. The opaque coating is substantially the same size as the message area for substantially entirely covering the area. The opaque material is removable for selectively revealing the message. Preferably, the opaque sticker is the same size as the paper sticker for entirely covering the paper sticker.

DISCLOSURE OF PREFERRED EMBODIMENT

Other objects, features and advantages will occur from the following description of preferred embodiments and the accompanying drawings, in which.

Figure 1:
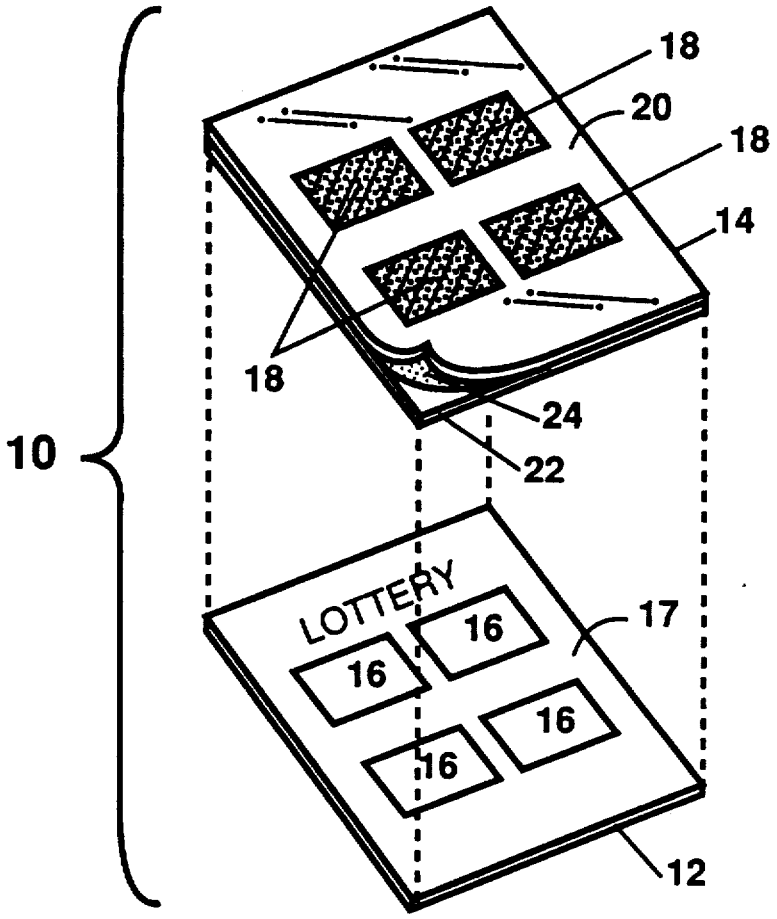
FIG. 1 is an axonometric view of an unassembled personalized hidden message device according to this invention in the form of an imitation lottery ticket.

There is shown in FIG. 1 a self-assembled personalized message device 10 according to this invention in the form of an imitation lottery ticket. Device 10 includes base 12 which may be preprinted, for example with the word lottery as shown, having a number of blank areas 16 on which messages can be written, for example in ink or pencil. Preferably, base 12 is a paper substrate; surface 17 may be at least partly covered outside of areas 16 by a substance which will not accept ink or pencil, for example a clear plastic coating over the preprinted areas, or colored material such as ink including words and/or patterns which convey some meaning. The coating or material confines the message to the message areas. In this example, the device is made as an imitation lottery ticket.

Top sheet 14 is the same size as base 12 and includes transparent cover sheet 20 with opaque areas 18. Back surface 24 of cover sheet 14 is at least partly covered with an adhesive material. The adhesive could alternatively be separate, or on the substrate outside of the message area. Backing sheet 22 is adhered to surface 24 and may be peeled away from cover sheet 14 to allow sheet 14 to be stuck to surface 17 of substrate 12. Opaque areas 18 are placed in the same locations as blank areas 16 so that they cover blank areas 16 when cover sheet 14 is stuck to base 12. This allows the message written in message areas 16 to be temporarily hidden from view.

Opaque areas 18 are preferably formed from a liquid material which may be screened or sprayed on surface 20 and dries to form a semi-adherent opaque coating which may be rubbed off of cover sheet 14. One material which may be used in this manner is "Zinc-Sele" brand cold galvanizing compound made by Rust-Oleum Corporation, 11 Hawthorne Parkway, Vernon Hills, Ill. 60061. When dry, the compound may be easily scratched or rubbed off cover sheet 14 to selectively reveal the message written in areas 16. Another material which may be used to form opaque areas 18 is the adhesive-backed metal foil covering disclosed in U.S. Pat. No. 3,822,901. The metal foil preferably has a thickness of between three and ten ten-thousandths of an inch and may be removed by rubbing or erasing. Other opaque, removable materials known to those skilled in the art may be also be used.

Cover sheet 20 is preferably a transparent plastic sheet. Backing sheet 22 is preferably a waxed or semi-adherent paper sheet which protects the adhesive on surface 24 and may be easily peeled off when device 10 is ready to be assembled. One example of material which may be used as top sheet 14 to accomplish both cover sheet 24 and backing sheet 22 is "Pres-a-ply" clear seal self-sealing plastic sheets manufactured by Dennison Manufacturing Company, Framingham, Mass. 01701.

Figure 2:
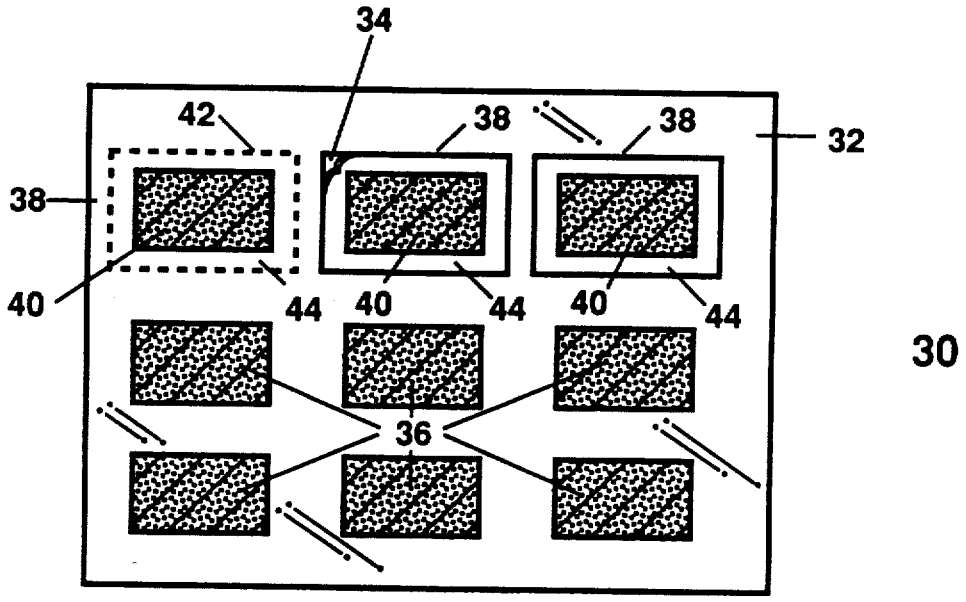
FIG. 2 is a top plan view of one embodiment of a transparent cover sheet of the personalized hidden message device according to this invention in which the opaque adherent areas are individually removable for selectively covering the message areas of the device.

Top sheet 30, FIG. 2, may be used in place of sheet 14, FIG. 1. Sheet 30 includes transparent cover sheet 32 with individually removable adhesive-backed opaque areas 38 and 36, for selective use in covering the message areas of the base substrate. Opaque areas 38 are rectangular tabs in cover sheet 32 which may be made removable by including perforated edge 42. Areas 38 include smaller rectangular areas 40 of opaque material and outer areas 44 of transparent material. Alternatively, the entire removable rectangular tab may be opaque as shown by areas 36. In either case, the individual tabs may be removed from backing sheet 34 as desired for use in individually covering the message areas of the message device.

Figure 3:
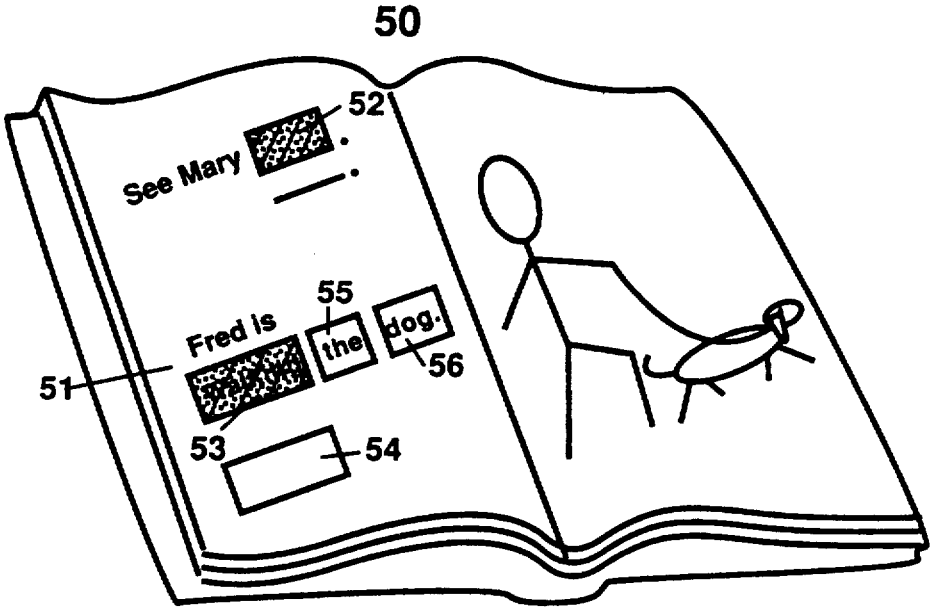
FIG. 3 is an axonometric view of an alternative personalized hidden message device according to this invention in the form of an instructional book.

Another embodiment of the message device according to this invention is shown in FIG. 3. Instructional book 50 illustrates two ways in which the message device according to this invention may be employed for teaching reading, writing and comprehension. Message area 52 is a blank area included in a sentence which the instructor may fill in, for example, with the word "run". An opaque cover such as areas 38 or 36, FIG. 2, may then be placed over message area 52. The student may then read the sentence and write down his or her word selection for the block. The student may then remove the opaque material to expose the correct word: in this manner the student is self-taught.

Alternatively, as shown in sentence 51, the written material may include a number of message areas which may be filled in by the instructor and/or student. In the example shown, the instructor has filled in message areas 53, 55 and 56, covering area 53 with an opaque semi-adherent cover tab. Message area 54 is then left blank for the student's use. The use of a number of blanks allows the instructor to tailor the sentence structure to the student's needs and abilities. In this case, the student would read the sentence as: "Fred is [blank] the dog." The student would then write his or her word selection in message area 54 and rub the opaque material off of area 53 to expose the word "walking". The student may then compare his word selection to that of the teacher. This arrangement allows the instructor to prepare the material in advance for individual use by the student or, in the alternative, to correct the student's use of the materials.

Figure 4:
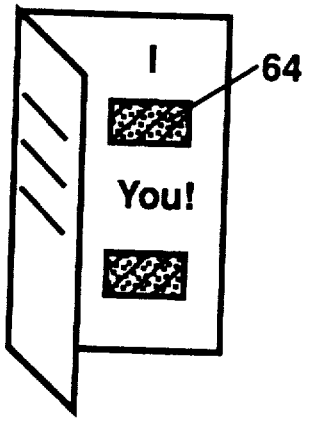
FIG. 4 is an axonometric view of another alternative personalized message device according to this invention in the form of a greeting card.

Another embodiment of the self-assembled personalized message device according to this invention is shown in FIG. 4. Greeting card 60 includes a preprinted message on the cover and a partially preprinted message on inside page 62. Message areas 64 and 66 are included to allow the purchaser to prepare a personalized message, which may be sincere or may be a "gag" message. After filling in message area 64 and 66 as desired, the purchaser would cover those areas either with the individual opaque areas of FIG. 2 or one-piece cover sheet 14, FIG. 1. This arrangement allows the design of greeting cards in which a single card may be used for more than one purpose; it also allows the card purchaser to be creative within the boundaries of the partially preprinted message.

Figure 5:
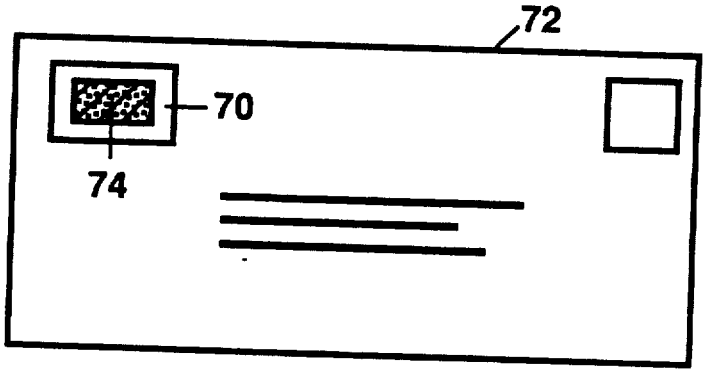
FIG. 5 is a top plan view of an envelope including the device of this invention employed as a confidential return address.
Figure 6:
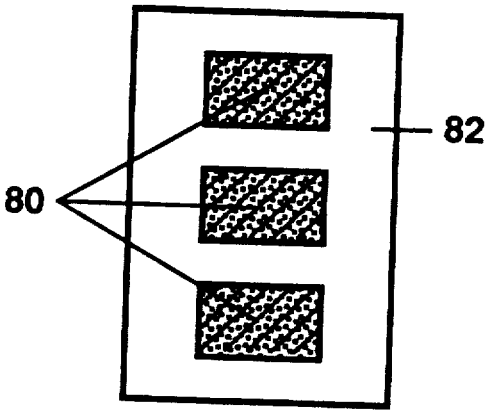
FIG. 6 is a top plan view of an alternative embodiment of the message areas of the device of this invention.

The message device may also be used as a confidential return address on envelope 72, FIG. 5. Message area 70 may be a blank area on envelope 72, but is preferably an adhesive-backed rectangular paper sticker. Sticker 70 may be printed with a return address, and covered with opaque area 74 for keeping the return address confidential. In yet another embodiment, individually removable adhesive-backed message areas 80, FIG. 6, may be removably held on non-stick substrate 82. Stickers 80 may be written on, peeled off substrate 82, and stuck where desired to convey a message. Stickers 80 may then be covered with an opaque area such as areas 42 or 36, FIG. 2, to hide the message until the opaque material is removed by the message recipient.

Although specific features of the invention are shown in some drawings and not others, this is for convenience only as each feature may be combined with any or all of the other features in accordance with the invention.

Other embodiments will occur to those skilled in the art and are within the following claims, for example the message device may take the form of any written or even pictoral material:

What is claimed is:

1. A self-assembled multi-part personalized hidden message device, comprising:

a base substrate including at least one blank message area on which a message may be written;

a transparent cover sheet, having front and back surfaces, for covering said message area;

means for adhering said cover sheet to said base substrate; and a plurality of separate, spaced, areas of removable, opaque coating on said cover sheet for obscuring said message area when said cover sheet is adhered to said substrate, said opaque material capable of being rubbed off of said cover sheet without disrupting the cover sheet for selectively revealing the message in the message area.

2. The message device of claim 1 in which said substrate includes the same number of message areas as there are separate, spaced opaque areas on said cover sheet.

3. The message device of claim 2 in which said opaque areas are arranged on said cover sheet to be aligned with said message areas when said cover sheet is adhered to said base substrate.

4. The message device of claim 1 in which said separate areas of said opaque coating are individually separable from said cover sheet to allow individual areas to be placed on said message area.

5. A self-assembled multi-part personalized hidden message device, comprising:

a base substrate including at least one blank message area in which a message may be written;

a transparent cover sheet, having front and back surfaces, for covering said message area;

an adhesive substance on the back surface of said cover said sheet for adhering said cover sheet to said base substrate;

a semi-adherent protective sheet severable from said adhesive substance for provisionally protecting said adhesive substance; and a removable, opaque coating on selected areas of the front surface of said cover sheet for obscuring said message area when said cover sheet is adhered to said substrate, said opaque material capable of being rubbed of said cover sheet without disrupting the cover sheet for selectively revealing the message in the message area.

6. A self-assembled multi-part personalized hidden message device, comprising:

a base substrate including at least one blank message area on which a message may be written and being preprinted outside of said blank message area;

a transparent cover sheet, having front and back surfaces, for covering said message area;

means for adhering said cover sheet to said base substrate; and a removable, opaque coating on selected areas of the front surface of said cover sheet for obscuring said message area when said cover sheet is adhered to said substrate, said opaque material capable of being rubbed off of said cover sheet without disrupting the cover sheet for selectively revealing the message in the message area.

7. A self-assembled multi-part personalized hidden message device, comprising:

a base substrate including at least one blank message area on which a message may be written;

a transparent cover sheet, having front and back surfaces, for covering said message area;

means for adhering said cover sheet to said base substrate, said means for adhering on said base substrate outside of said message area; and a removable, opaque coating on selected areas of the front surface of said cover sheet for obscuring said message area when said cover sheet is adhered to said substrate, said opaque material capable of being rubbed off of said cover sheet without disrupting the cover sheet for selectively revealing the message in the message area.

8. A self-assembled multi-part personalized hidden message device, comprising:

a base substrate including at least one blank message area on which a message may be written;

a transparent cover sheet, having front and back surfaces, the same size as said base substrate for entirely covering said substrate;

means for adhering said cover sheet to said base substrate; and a removable, opaque coating on selected areas of the front surface of said cover sheet for obscuring said message area when said cover sheet is adhered to said substrate, said opaque material capable of being rubbed off of said cover sheet without disrupting the cover sheet for selectively revealing the message in the message area.

9. A self-assembled multi-part personalized hidden message sticker device, comprising:

a paper sticker including a paper substrate with an adhesive material on one face removably covered with a removable material for protecting said adhesive before use, and a blank area on the other face for containing a message;

an opaque sticker including an adhesive-backed transparent substrate covered on the front with a removable opaque coating and being substantially the same size as said paper sticker for substantially entirely covering said paper sticker when said opaque sticker is adhered to said other face of said paper sticker; and said opaque material capable of being rubbed off of said transparent substrate without disrupting the transparent substrate to selectively reveal the message written in said message area.

* * * * *